United States Patent [19]

Nawa et al.

[11] 4,266,722

[45] May 12, 1981

[54] FLUID DEFLECTING ASSEMBLY

[75] Inventors: Motoyuki Nawa; Yutaka Takahashi, both of Nara; Norio Sugawara, Yamatokoriyama, all of Japan

[73] Assignee: Matsushita Electric Industrial Co., Ltd., Kadoma, Japan

[21] Appl. No.: 931,282

[22] Filed: Aug. 4, 1978

[30] Foreign Application Priority Data

Aug. 10, 1977 [JP] Japan ..... 52-95904
Oct. 24, 1977 [JP] Japan ..... 52-128037
Oct. 24, 1977 [JP] Japan ..... 52-128041

[51] Int. Cl.[3] ..... B05B 1/04

[52] U.S. Cl. ..... 239/590.5; 239/DIG. 7; 98/40 N; 60/230

[58] Field of Search ..... 98/40 R, 40 V, 40 D, 98/40 N, 40 VM, 107, 108, 110, 114, 121 R, 121 A; 239/DIG. 7, 590.5; 137/829, 803; 60/230

[56] References Cited

U.S. PATENT DOCUMENTS

| | | | |
|---|---|---|---|
| 2,684,690 | 7/1954 | Lee | 98/40 V |
| 2,702,986 | 3/1955 | Kadosch et al. | 60/35.54 |
| 2,812,980 | 11/1957 | Kadosch et al. | 239/DIG. 7 |
| 3,102,389 | 9/1963 | Pedersen et al. | 60/35.54 |
| 3,597,166 | 8/1971 | Hochman | 239/590.5 |
| 3,621,859 | 11/1971 | Scott | 137/829 |
| 3,642,093 | 2/1972 | Schach | 98/40 R |
| 3,998,393 | 12/1976 | Petty | 239/590.5 |
| 4,141,507 | 2/1979 | Rump | 239/590.5 |
| 4,146,357 | 3/1979 | Ward et al. | 239/DIG. 7 |

*Primary Examiner*—Henry C. Yuen
*Attorney, Agent, or Firm*—Wenderoth, Lind & Ponack

[57] ABSTRACT

A fluid deflecting assembly has a nozzle defining structure having a fluid duct defined therein and a deflecting blade pivotally supported within the fluid duct. One of walls forming the nozzle defining structure has a wall portion adjacent the exit opening outwardly diverging in a direction downstream with respect to the direction of flow of the fluid medium through the fluid duct. Depending upon the position of the deflecting blade, the stream of fluid medium is forced to adhere to the outwardly diverging wall portion to attain a relatively wide angle of deflection.

1 Claim, 21 Drawing Figures

FLUID DEFLECTING ASSEMBLY

BACKGROUND OF THE INVENTION

The present invention relates to a fluid deflecting assembly.

As one of fluid deflecting assemblies, there is known a fluid logic element the wall adherence type wherein the wall adherence phenomenon is utilized in deflecting the direction of flow of a fluid medium. This wall adherence fluid logic element comprises, as shown in FIG. 1 of the accompanying drawings which illustrates such fluid logic element in a schematic longitudinal sectional view, a supply nozzle 2, defined by a pair of parallel walls 1*a* and 1*b* spaced a distance Ws from each other, a pair of curved walls 3*a* and 3*b* located at a position downstream of the direction of flow of a stream of air and so shaped as to outwardly diverge from each other in a direction downstream of the flow of the air stream, and a pair of opposed control chambers 4*a* and 4*b* positioned downstream of the nozzle 2 and upstream of the curved walls 3*a* and 3*b* and on respective sides of an air passage defined between the walls 1*a*, 3*a* and 1*b*, 3*b*. The control chambers 4*a* and 4*b* are respectively communicated with the atmosphere through control apertures 5*a* and 5*b* each adapted to be selectively closed and opened in any desired or required manner.

In the construction shown in FIG. 1, where the air stream is desired to be deflected at a relatively wide angle, such as shown by $\beta$, relative to a direction parallel to the direction A of flow of the air stream passing through the nozzle 2, by developing a pressure differential between the control chambers 4*a* and 4*b*, the curved wall 3*b* to which the air stream adheres incident to the closure of the control aperture 5*b* (or the curved wall 3*a* to which the air stream adheres incident to the closure of the control aperture 5*a*) must be curved to have a relatively great angle of arch while the length L of the fluid logic element as measured from the point at which the air stream emerges outwardly from the nozzle 2 to the point lying in a plane parallel to the exit opening defined between the free ends of the walls 3*a* and 3*b* remote from the associated control chambers 4*a* and 4*b*, has to be five or six times the width Ws of the nozzle 2.

Moreover, with the fluid logic element of the construction shown in FIG. 1, it is not possible to control continuously the direction of flow of the air stream.

There is also known another type of fluid deflecting assembly having a construction such as shown in FIGS. 2 and 3 which illustrate such fluid deflecting assembly in front elevational and side sectional views, respectively. The fluid deflecting assembly having the construction shown in FIGS. 2 and 3 comprises a nozzle defining structure 6, including top and bottom walls 6*a* and 6*b* and a pair of opposed side walls 6*c* and 6*d* joined together to provide an air passage of substantially rectangular cross section, and a movable louver constituted by a plurality of elongated blades 7 rigidly mounted on respective shafts 8 each having its opposite ends journalled in the adjacent side walls 6*c* and 6*d*. These louver blades 7 are at one end corner pivotally linked together by a link 9 so that when the link 9 is moved linearly, all of the louver blades 7 are simultaneously pivoted about the shafts 8.

In the construction as shown in FIGS. 2 and 3, assuming that air under pressure is supplied into the nozzle defining structure 6 in the direction shown by the arrow C while the louver blade 7 are positioned as shown in FIG. 3 for deflecting the air in a direction substantially downwards as viewed in FIG. 3, the air so supplied is divided into a plurality of currents by the respective louver blades 7 and then deflected in a direction as shown by the arrow D after having impinged upon the louver blades 7. However, one of the air currents flowing through a clearance between the bottom wall 6*b* and the adjacent, lowermost louver blade 7 tends to flow in a direction parallel to the plane of the bottom wall 6*b*, as shown by the arrow F, and, therefore, collides with the air currents flowing in the direction D. On the other hand, another air current flowing through the clearance between the top wall 6*a* and the adjacent, topmost louver blade 7 flows in a straight direction parallel to the plane of the top wall 6*a* without being deflected by any of the louver blades 7.

With the fluid deflecting assembly having the construction shown in FIGS. 2 and 3, the angle through which the air stream formed by the air currents as they emerge from the nozzle defining structure 6 can be deflected is limited and, in addition, the deflected flow of air cannot be concentrated in one desired or predetermined direction. However, in the construction shown in FIGS. 2 and 3, if the pitch P between every adjacent two of the louver blades 7 is selected to have a relatively small value while the width W of each of the louver blades 7 is simultaneously selected to have a relatively great value, a relatively wide angle of deflection is available, but this in turn is accompanied by an increased resistance to the flow of air through the nozzle defining structure 6, thereby reducing the rate of flow of the air stream as the latter emerges from the nozzle defining structure 6.

SUMMARY OF THE INVENTION

Accordingly, the present invention has for its essential object to provide an improved fluid deflecting assembly of a type capable of continuously deflecting an air stream at a relatively wide angle of deflecting with substantially no flow resistance imposed on the air flowing through the assembly.

Another object of the present invention is to provide an improved fluid deflecting assembly of the type referred to above which can be manufactured in a compact size, particularly having a relatively small depth.

A further object of the present invention is to provide an improved fluid deflecting assembly of the type referred to above wherein there is provided an extra fluid passage for directing an air stream inwardly of the assembly for the purpose of enhancing the downward deflection of the air stream emerging from the assembly.

A still further object of the present invention is to provide an improved fluid deflecting assembly of the type referred to above wherein, at a downstream side of an inlet guide wall, there is provided a detachment region, formed by providing a clearance at a position rearwardly of the direction of flow of air stream or shaping the inlet guide wall so as to form a rapidly converging vena-contracta, so that when the air stream emerging from the assembly is to flow in a horizontal direction, a portion of the air stream flowing underneath a deflecting blade will not adhere to an exit guide wall.

A still further object of the present invention is to provide an improved fluid deflecting assembly of the type referred to above wherein, by suitably shaping the inlet guide wall so that the width of the flow passage will gradually decrease in the direction of flow of the air stream, whereby the resistance to the flow of the air stream is reduced.

A still further object of the present invention is to provide an improved fluid deflecting assembly of the type referred to above wherein, by suitably shaping the inlet guide wall not to vary the width of the flow passage, the air stream flowing past the deflecting blade can readily be adhered to the exit guide wall.

A still further object of the present invention is to provide an improved fluid deflecting assembly of the type referred to above wherein the deflecting blade is so positioned that the opposed side edges of the deflecting blade can be located on the upstream and downstream of the narrowest region of the flow passage with respect to the direction of flow of the air stream, thereby enhancing the capability of wide angle deflection.

A still further object of the present invention is to provide an improved fluid deflecting assembly of the type referred to above wherein the deflecting blade has a substantially air foil shaped cross section to define a deflection aiding flow passage so that a relatively wide angle of deflection is available.

A still further object of the present invention is to provide an improved fluid deflecting assembly of the type referred to above wherein the air foil-shaped deflecting blade has a protuberance so that the air current flowing through the deflection aiding flow passage can be transformed into a jet of air effective to provide a suction force necessary to forcibly deflect the air stream.

A still further object of the present invention is to provide an improved fluid deflecting assembly of the type referred to above wherein there is provided means for directing an air stream inwardly of the assembly, which is positioned at the downstream side of the exit guide wall so that the downward deflection of the air stream can be effectively enhanced.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
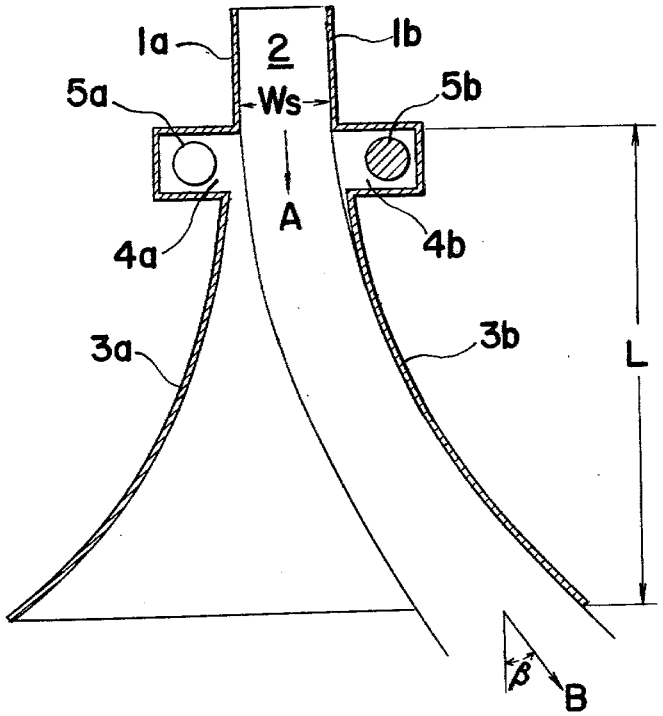
Fig. 1 Prior Art
FIG. 1 is a schematic longitudinal sectional view of the prior art fluid deflecting assembly.

Before the description of the present invention proceeds, it is to be noted that like parts are designated by like reference numerals throughout the accompanying drawings.

Referring first to FIGS. 4 to 8, a fluid deflecting assembly embodying the present invention comprises a nozzle defining structure, generally indicated by 10 and constituted by rectangular top and bottom panels **12*a* and 12*b* and a pair of opposed side panels 12*c* and 12*d* connected in any known manner to provide a fluid duct 14 of substantially rectangular cross section. The fluid duct 14 extends at right angles to the lengthwise direction of either of the top and bottom panels 12*a* and 12*b* and in parallel to the plane of either of the side panels 12*c* and 12*d* and has supply and exit openings defined at 14*a* and 14*b*, respectively, the supply opening 14*a*** being adapted to be communicated to a source of existing fluid medium, for example, a flow of air.

It is to be noted that the terms "upstream" and "downstream" hereinafter used in describing and claiming the present invention are intended to refer to the direction of flow of the fluid medium under pressure from the supply opening **14*a* towards the exit opening 14*b* through the fluid duct 14**.

The fluid deflecting assembly further comprises a guide wall structure rigidly mounted on the bottom panel **12*b* and extending within the fluid duct 14 between the side panels 12*c* and 12*d*. This guide wall structure is constituted by inlet and exit guide walls 16 and 18 each being curved in the widthwise direction thereof in a manner as will be described in detail later. The inlet guide wall 16 has one side edge 16*a* rigidly secured to a portion of the bottom panel 12*b* substantially intermediately of the width of said panel 12*b* while the exit guide wall 18 has one side edge 18*a* rigidly secured to a side edge of the bottom panel 12*b* which lies in the plane of the exit opening 14*b*. The opposite side edge 16*b* of the inlet guide wall 16 and the opposite side edge 18b of the exit guide wall 18 are jointed together in stepped relation to each other, the side edge 16b being positioned above the side edge 18b, to provide a detachment step 20 of a relatively small height as indicated by Se. The inlet guide wall 16 so installed and is so curved widthwise as to have a shape diverging away from the top wall 12a in a direction upstream with respect to the direction of flow of air from the supply opening 14a towards the exit opening 14b, whereas the exit guide wall 18 is so curved widthwise as to have a shape diverging away from the top wall 12a in a direction downstream with respect to the direction of flow of the same air from the supply opening 14a towards the exit opening 14b**.

The guide wall structure so constructed and so installed within the fluid duct 14 provides a substantially constricted area in the fluid duct 14 at a position above the detachment step 20.

The nozzle defining structure 10 includes means for directing a portion of an air stream flowing through the fluid duct 14 to flow inwardly of the fluid duct 14, particularly in a direction towards the exit guide wall 18, and a deflecting blade. The directing means is constituted by a substantially L-shaped beam 22 having a wall portion 22a secured to, or integrally formed with, one side edge of the top panel 12a which lies in the plane of the exit opening 14b, and a wall portion 22b protruding from the wall portion 22a in a direction inwardly of the fluid duct 14 in parallel to the top panel 12a.

The deflecting blade is designated by 24 and extends between the side panels 12c and 12d traversing the fluid duct 14. This deflecting blade 24 is carried by a shaft 26, having its opposite ends journalled on the side panels 12c and 12d, and is positioned immediately above the detachment step 20 and substantially intermediately between the top panel 12a and the detachment step 20. Although not shown, one end of the shaft 26 protrudes outwards through the corresponding side panel 12d and is in turn coupled through a suitable transmission system to a drive mechanism, such as one or both of a manipulatable switching knob and an electrically operated motor, so that the deflecting blade 26 can be pivoted about the shaft 26, either adjustably or continuously depending upon the type of the drive mechanism, between a lift position, in which a stream of fluid medium, for example, an air stream, can emerge from the exit opening 14b in a direction generally parallel to the direction of flow of an air through the supply opening 14a, and a descent position in which the air stream can emerge from the exit opening 14b in a direction outwardly deviating from the direction of flow of the air through the supply opening 14a and along the curved exit guide wall 18.

It is to be noted that the deflecting blade 24 thus supported is held in position in such a manner that the opposite side edges of said deflecting blade 24, which are hereinafter referred to as upstream and downstream edges, are situated on respective sides of and above the detachment step 20 and adjacent the supply and exit openings 14a and 14b, respectively, the downstream edge of said deflecting blade 24 being located upstream of a plane which is parallel to the plane of the exit opening 14b and passes through the free side edge of the wall portion 22b remote from the wall portion 22a.

While the fluid deflecting assembly according to the first preferred embodiment of the present invention is constructed as hereinbefore described, it is to be noted that the guide wall structure, which has been described as constituted by separate members 16 and 18, may be made of a single wall member and, therefore, may have a one-piece construction. Similarly, the directing means, which has been constituted by the L-shaped beam 22, may be a monolithic part of the top panel 12a.

The operation of the fluid deflecting assembly having the construction as hereinbefore described will now be described with particular reference to FIGS. 6 to 8.

Figure 6:
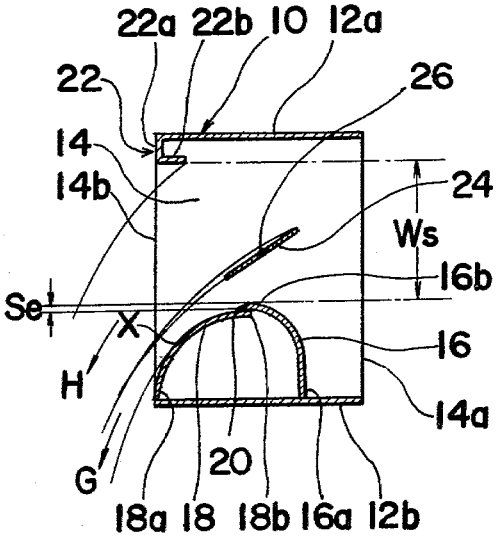
FIG. 6 is a cross sectional view taken along the line VI—VI in FIG. 5.

In FIG. 6, the deflecting blade 24 is shown held in the descent position wherein the downstream edge of said deflecting blade 24 is spaced a minimum possible distance from the exit guide wall 18. In this condition, the air under pressure entering the supply opening 14a in a direction substantially perpendicular to the plane of the opening 14a is divided into two currents by the deflecting blade 24. One of these air currents which flows through the lower clearance between the deflecting blade 24 and the inlet guide wall 16, after having been deflected by the deflecting blade 24, flows downwards, as viewed in FIG. 6, along the curved exit guide wall 18 and finally adheres to the guide wall 18 by the action of the known Coanda effect. Once this wall adherence takes place, the air current flowing along the guide wall 18 is positively drawn towards the guide wall 18 and is, therefore, directed downwards diverging outwardly from the plane of the bottom panel 12b in a direction as shown by the arrow G and subsequently separating from the guide wall 18 at a point indicated by X.

On the other hand, the other air current flowing through the upper clearance between the deflecting blade 24 and the top panel 12a is, by the effect of back pressure developed by the substantially L-shaped beam 22, directed downwards diverging outwardly from the plane of the top panel 12a in a direction as indicated by the arrow H. As the air current flowing in the direction H joins the air current flowing in the direction G, entrainment takes place between these two air currents and the resultant air stream as a whole flows in a direction parallel to the direction G, that is, downwards in a direction outwardly diverging from the plane of the bottom panel 12b.

Figure 7:
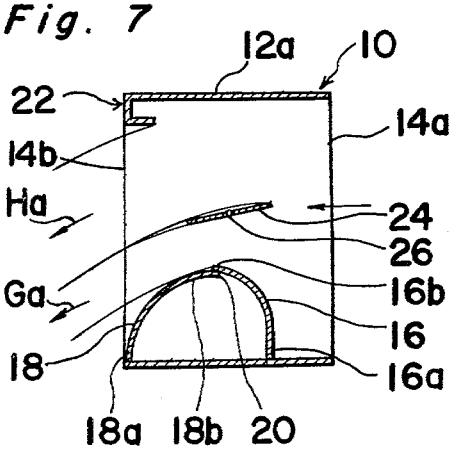
FIGS. 7 and 8 are views similar to FIG. 6, showing a deflecting blade at different operative positions.

If it is desired to direct the air stream emerging from the exit opening 14b of the fluid duct 14 in a direction substantially diagonally downwards, the deflecting blade 24 is positioned as shown in FIG. 7. In FIG. 7, the deflecting blade 24 is so positioned that the downstream edge of the deflecting blade 24 is lifted upwardly as compared with the position of the deflecting blade 24 shown in FIG. 6. In this condition, the air current flowing through the lower clearance between the deflecting blade 24 and the inlet guide wall 16 adheres to the exit guide wall 18 in a substantially similar manner as in the case of FIG. 6, but the point Y where the air current that has adhered to the guide wall 18 separates is shifted a certain distance upstream of the detachment point X shown in FIG. 6. This is because the deflecting blade 24 is so positioned as to deflect the air current flowing through the lower clearance at an angle of deflection relative to the plane of the exit opening 14b which is larger than that in the case of FIG. 6. Therefore, the air current passing out of the lower clearance flows in a direction as indicated by the arrow Ga.

Figure 8:
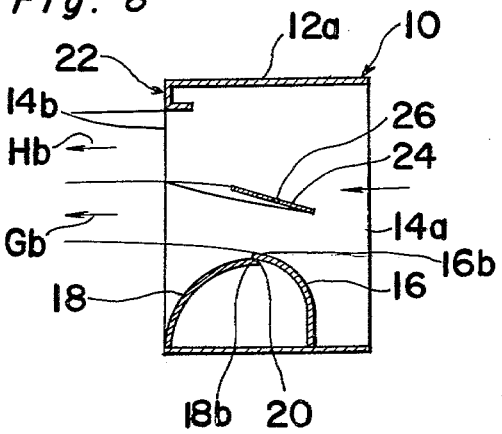

On the other hand, the air current flowing through the upper clearance between the top panel 12a and the deflection blade 24 is forced to flow in a downwards direction by the effect of back pressure developed by the substantially L-shaped beam 22 in a similar manner as hereinbefore described with reference to FIG. 6 and is, subsequently, entangled by the air current flowing out of the lower clearance, thereupon flowing in a direction, as indicated by Ha, generally parallel to the direction Ga of flow of the air current from the lower clearance. Accordingly, the air stream emerging from the exit opening 14*b* as a whole flows diagonally downwards at a smaller angle of deflection than that in the case of FIG. 6.

Where the air stream emerging from the exit opening 14*b* is desired to be directed in a generally horizontal direction substantially perpendicular to the plane of the exit opening 14*b*, the deflecting blade 24 is positioned in the lift position as shown in FIG. 8. In this lift position, the downstream edge of the deflecting blade 24 is spaced a maximum possible distance from the exit guide wall 18. In this condition, the air current flowing through the upper clearance between the top panel 12*a* and the deflecting blade 24 tends to flow downwards under the influence of the back pressure developed by the substantially L-shaped beam 22. However, since a lower layer of the air current flowing through the upper clearance in contact with and over the deflecting blade 24 is upwardly lifted by the deflecting blade 24 in the lift position, the air current flowing out of the upper clearance flows, as a whole, in a generally horizontal direction as indicated by the arrow Hb.

On the other hand, the air current flowing through the lower clearance between the deflecting blade 24 and the inlet guide wall 16 flows in a generally horizontal direction, as indicated by the arrow Gb, because the direction of flow thereof is determined by the side edge 16*b* of the inlet guide wall 16. The air currents respectively flowing out of the upper and lower clearances are subsequently joined together as they emerge from the exit opening 14*b*, the resultant air stream consequently flowing in the generally horizontal direction. It is to be noted that the air current flowing out of the lower clearance does not adhere to the exit guide wall 18 since it separates from the inlet guide wall 16 at the detachment step 20 as clearly shown in FIG. 8.

Figure 2:
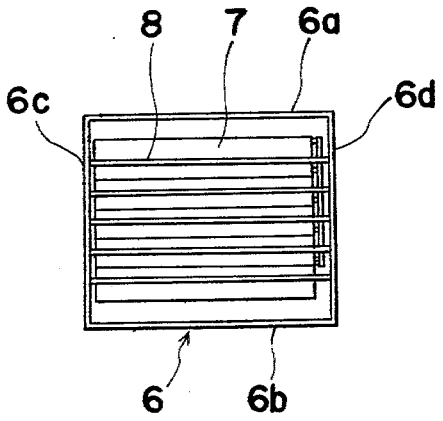
Fig. 2 Prior Art
FIGS. 2 and 3 are schematic front sectional and side sectional views of the prior art fluid deflecting assembly employing a movable louver.
Figure 3:
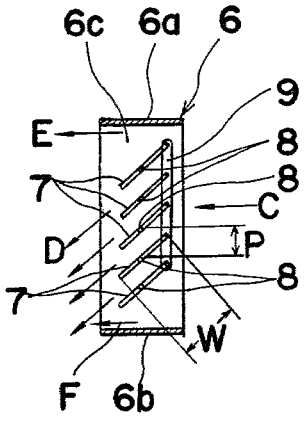
Fig. 3 Prior Art
Figure 4:
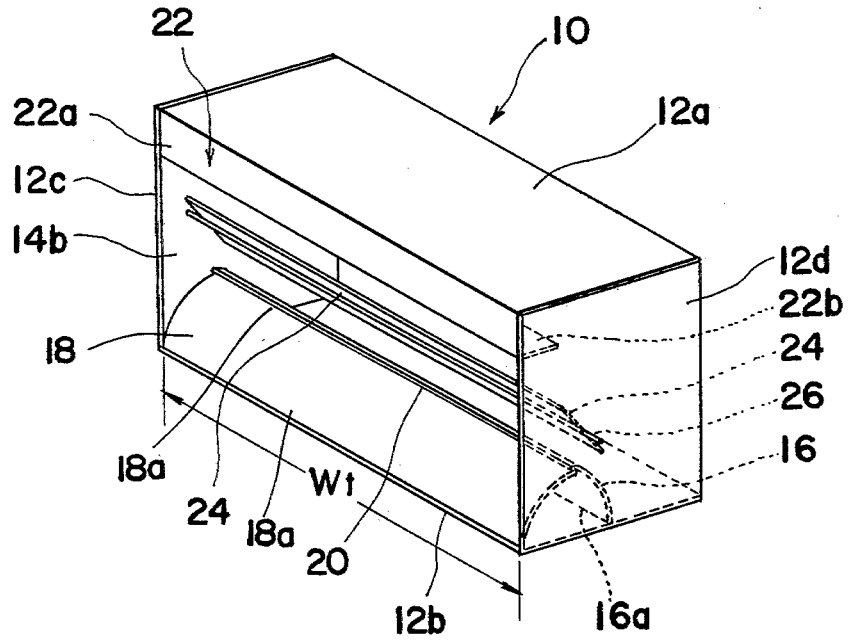
FIG. 4 is a schematic perspective view of a fluid deflecting assembly according to one preferred embodiment of the present invention.
Figure 5:
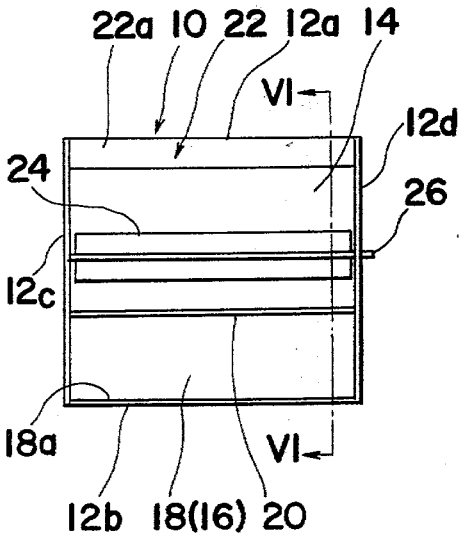
FIG. 5 is a schematic front elevational view of the fluid deflecting assembly shown in FIG. 4.

From the foregoing, it will readily be seen that the deflection of the air stream emerging from the exit opening 14*b* is controlled mainly by the air current flowing through the lower clearance between the deflecting blade 24 and the inlet guide wall 16. Due to the continuous shift of the separation point according to the blade rotation, the air stream can be deflected in any desired direction. Since only the deflecting blade 24 is sufficient to enable the fluid deflecting assembly to achieve a relatively wide angle of deflection of the air stream, no substantial reduction in flow rate of the air stream takes place as compared with an assembly, such as shown in FIGS. 2 and 3, wherein a plurality of blade members are employed.

According to a series of experiments, it has been demonstrated that the fluid deflecting assembly having the construction shown in FIGS. 4 to 8 wherein the depth of the fluid duct 14 as measured between the respective planes of the supply and exit openings 14*a* and 14*b* is not more than twice the nozzle width Ws as measured between the side edge 16*b* of the inlet guide wall 16 and the plane in which the wall portion 22*b* of the beam 22 lies, as shown in FIG. 6, can operate to attain an angle of deflection of 60°.

It is to be noted that in the embodiment shown in FIGS. 4 to 8 as well as the other embodiments shown in FIGS. 9 to 19, the fluid deflecting assembly is shown as having a width Wt greater than the nozzle width, so that the fluid deflecting assembly can advantageously be used as an exit grill structure in an air conditioner.

Figure 9:
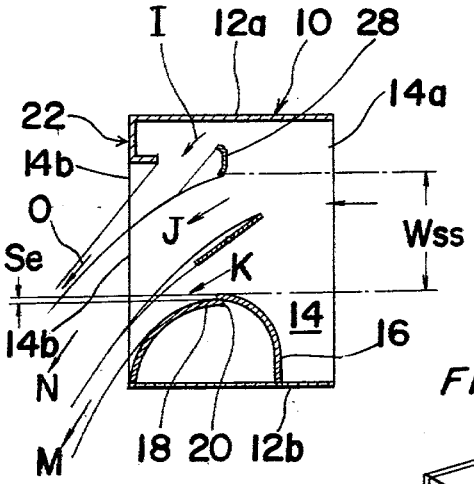
FIGS. 9 is a view similar to FIG. 6, showing the fluid deflecting assembly according to another preferred embodiment of the present invention.

Referring to FIG. 9, the fluid deflecting assembly having the construction shown in FIGS. 4 to 8 is shown as having a divider 28 which is rigidly positioned above the deflecting blade 24 and below the top panel 12*a* and extends between the side panels 12*c* and 12*d*. This divider 28 has a shape having its opposite side edge portions curved widthwise of the elongated divider to face the exit opening 14*b*.

While the fluid deflecting assembly having the divider 28 operates in a substantially similar manner to the fluid deflecting assembly having the construction shown in FIGS. 4 to 8 when the deflecting blade 24 is positioned as shown in either FIG. 7 or FIG. 8, that is, substantially intermediately between the lift and descent positions or at the lift position, it operates in the following manner when the deflecting blade 24 is held at the descent position as shown in FIG. 9.

The air current K flowing through the lower clearance between the inlet guide wall 16 and the deflecting blade 24 flows in a substantially similar manner to that as shown in FIG. 6 and in a direction as indicated by the arrow M. However, the air current flowing through the upper clearance between the deflecting blade 24 and the top panel 12*a* is divided by the divider 28 into two current portions respectively shown by I and J; the current portion I flowing through the gap between the divider 28 and the top panel 12*a* and the current portion J flowing through the gap between the divider 28 and the deflecting blade 24. The current portion I is, after having flowed through the gap between the top panel 12*a* and the divider 28, forced to flow in a downward direction under the influence of the back pressure developed by the beam 22 while the current portion J is, after having flowed through the gap between the deflecting blade 24 and the divider 28, forced by the current portion I to flow in a downward direction. As the current portions J and K join to each other, entrainment takes place between these current portions and, therefore, the current portion J subsequently flows in a direction N generally parallel to the direction M of flow of the air current flowing out of the lower clearance. Simultaneously therewith, the current portion I flows in a direction O generally parallel to the direction N. Therefore, the air stream as a whole emerging from the exit opening 14*a* will flow in the downward direction.

Even with the fluid deflecting assembly having the construction shown in FIG. 9, a depth of the fluid duct 14 of a value not more than twice the nozzle width Wss as measured between the side edge 16*b* of the inlet guide wall 16 and the lower side edge of the divider 28 remote from the top panel 12*a* has been demonstrated to be sufficient for the fluid deflecting assembly to attain an angle of deflection of about 60°.

It is to be noted that, in any of the foregoing embodiments respectively shown in FIGS. 4 to 8 and FIG. 9, the inlet and exit guide walls 16 and 18 need not always be curved as shown, but may be straight so far as deflection of the air stream through a desired or required angle relative to the direction perpendicular to the axis of rotation of the deflecting blade 24 can be attained. By way of example, one or both the guide walls 16 and 18 may be of a flat plate shape and may be so arranged as to have the junction of the respective side edges 16*b* and 18*b* of these walls 16 and 18 positioned above and spaced a distance from the bottom panel 12*b*.

Figure 10:
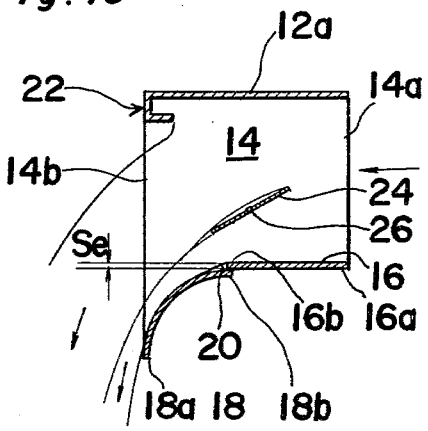
FIG. 10 is a view similar to FIG. 6, showing the fluid deflecting assembly according to a further preferred embodiment of the present invention.
Figure 11:
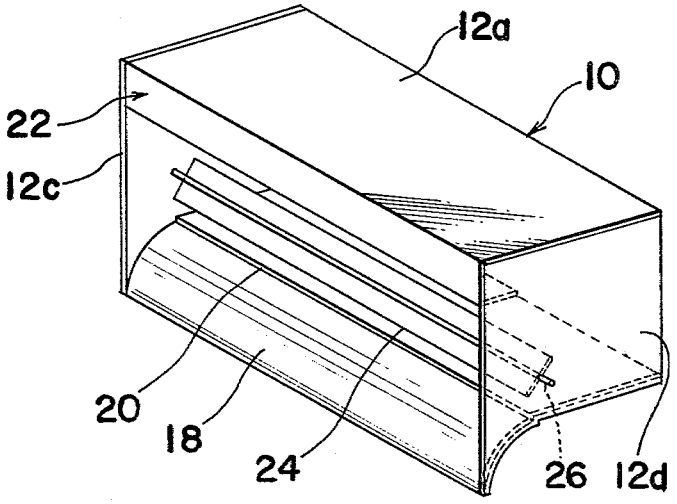
FIG. 11 is a schematic perspective view of the fluid deflecting assembly shown in FIG. 10.

In the embodiment shown in FIGS. 10 and 11, the inlet guide wall 16 is a flat plate shape and extends between the side panels 12*c* and 12*d* parallel to the top panel 12*a*. In this embodiment, since the widthwise direction of the inlet guide wll 16 extends substantially between the side edge 18*b* and the plane of the supply opening 14*a*, the guide walls 16 and 18 together form a part of the nozzle defining structure 10 and, therefore, the bottom panel such as indicated at 12*b* in FIGS. 3 to 9, may not be necessary. As is the case with any one of the foregoing embodiments, the side edge 16*b* of the inlet guide wall 16 is connected to and positioned above the adjacent side edge 18*b* of the exit guide wall 18 to define the detachment step 20.

Even the fluid deflecting assembly having the construction shown in FIGS. 10 and 11 functions in a substantially similar manner to the fluid deflecting assembly having the construction shown in FIGS. 4 to 8, except that in the embodiment shown in FIGS. 10 and 11, a lower portion of the air current flowing through the lower clearance between the deflecting blade 24 and the inlet guide wall 16 flows in a straight direction parallel to the plane of the guide wall 16.

In describing the fluid deflecting assembly according to any one of the foregoing embodiments respectively shown in FIGS. 4 to 8, FIG. 9 and FIGS. 10 and 11, the detachment step 20 has been described as being employed. However, this detachment step 20 may not be always necessary and the side edges 16*b* and 18*b* of the guide walls 16 and 18 may be butted together or, in the case of the guide wall structure having one-piece construction, the guide wall 16 may be contiguous to the guide wall 18 with no step formed therebetween. However, what is required in the present invention is that, when the air stream emerging from the exit opening 14*b* is desired to be directed in the horizontal direction perpendicular to the axis of rotation of the deflecting blade 24, i.e., when the deflecting blade 24 is held in the lift position, the air current flowing out of the lower clearance does not adhere to the exit guide wall 18 and does not diverge from the air current flowing out of the upper clearance. In other words, the guide wall structure should be so designed that, when the deflecting blade 24 is held in the lift position, the air current flowing out of the lower clearance can readily separate from the side edge of the inlet guide wall 16 without adhering to the exit guide wall 18.

The fluid deflecting assembly wherein no detachment step such as indicated by 20 in any one of the foregoing embodiments is employed is illustrated in FIGS. 12 to 19, which will now be described.

Figure 12:
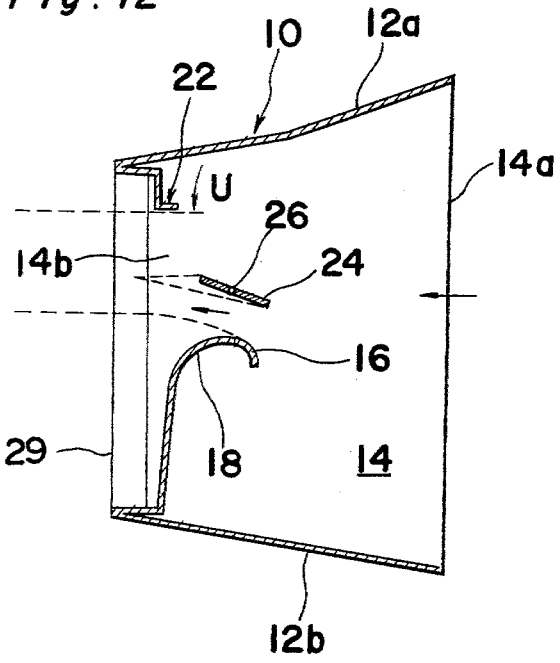
FIG. 12 is a schematic side sectional view of the fluid deflecting assembly according to a fourth preferred embodiment of the present invention.
Figure 13:
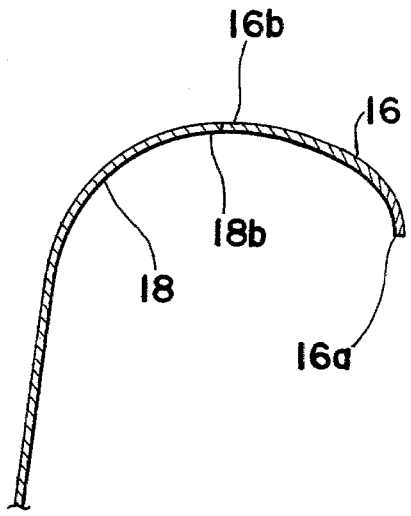
FIG. 13 is a side sectional view, on an enlarged scale, of a portion of a wall structure employed in the fluid deflecting assembly shown in FIG. 12.

Referring first to FIGS. 12 and 13, the difference between the embodiment shown in FIGS. 4 to 8 and the embodiment shown in FIGS. 2 and 3 resides essentially in the shape of the guide wall structure. As best shown in FIG. 13, in the embodiment of FIGS. 12 and 13, the inlet guide wall 16 and the exit guide wall 18 are butted together with no step or indent formed at the junction of these walls 16 and 18. In addition, as best shown in FIG. 12, the side edge of the inlet guide wall 18 adjacent the supply opening 14*a* is spaced from and is curved downwards towards the bottom panel 12*b*. In other words, the guide wall structure as a whole in the embodiment shown in FIGS. 12 and 13 extends from a portion of the bottom panel 12*b* adjacent the exit opening 14*b* substantially upwardly towards the deflecting blade 24 and, after being curved at a position below the deflecting blade 24 to assume the shape of a substantially inverted figure "U", terminates at a position spaced from a substantially intermediate portion of the bottom panel 12*b*. The curvature of the inlet guide wall 16 is so selected to have a small value such that the air current flowing below the deflecting blade 24 can be converged into the shape of a vena-contracta when the deflecting blade 24 is held in the lift position as shown, whereas the curvature of the exit guide wall 18 is selected to have a great value.

Figure 14:
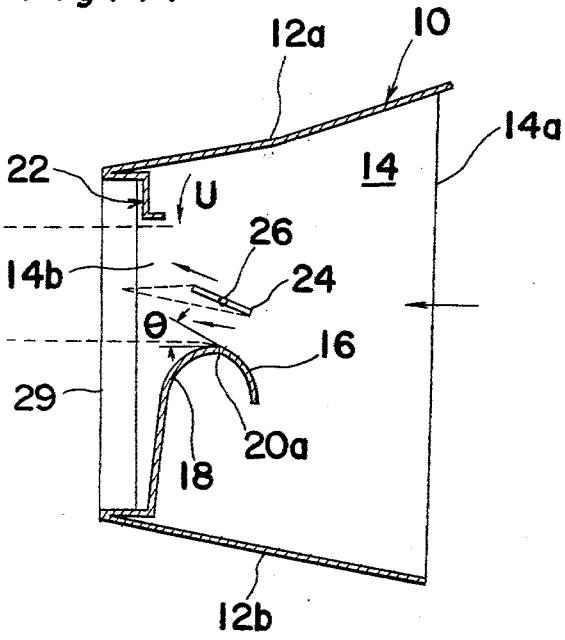
FIG. 14 is a view similar to FIG. 12, showing the fluid deflecting assembly according to a fifth preferred embodiment of the present invention.
Figure 15:
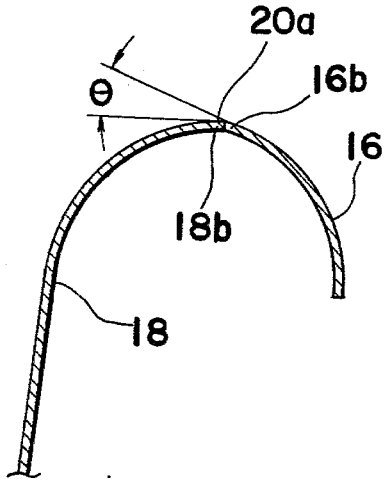
FIG. 15 is a side sectional view, on an enlarged scale, of a portion of a wall structure employed in the fluid deflecting assembly shown in FIG. 14.

In the fluid deflecting assembly having the construction shown in FIGS. 12 and 13, the wall adherence necessary to direct the air stream emerging from the exit opening 14*b* in the downward direction takes place when the deflecting blade 24 is held in the descent position. However, when the deflecting blade 24 is held in the lift position to enable the air stream to flow from the exit opening 14*b* in the horizontal direction perpendicular to the axis of rotation of the deflecting blade 24, since the curvature of the inlet guide wall 16 has a small value as hereinbefore described, the air current flowing through the lower clearance below the deflecting blade 24 is converged into the shape of a vena-contracta and, therefore, a pocket is developed between such air current and the exit guide wall 18. Because of the formation of this pocket between the air current flowing out of the lower clearance and the exit guide wall 18, the air current flowing out of the lower clearance does not adhere to the exit guide wall 18. On the other hand, the air current flowing out of the upper clearance above the deflecting blade 24 is in part forced to flow downwards, as indicated by U under the influence of the back pressure developed by the substantially L-shaped beam 22, but since such downwardly oriented portion of the air current flowing out of the upper clearance subsequently joins the remaining portion of the same air current which is lifted upwardly by the deflecting blade 24 in the lift position, the air current flowing out of the upper clearance as a whole is oriented to flow in the horizontal direction. After the air currents flowing out of the lower and upper clearances have joined with each other, the resultant air stream is caused to flow in the horizontal direction.

Where the separating region at which the air current flowing out of the lower clearance separates from the inlet guide wall 16 and subsequently flows without adhering to the exit guide wall 18 is required in the fluid deflecting assembly of having the construction shown in FIGS. 12 and 13, it can readily be formed by connecting the inlet and exit guide walls 16 and 18 in such a manner, as shown in FIGS. 14 and 15, that a tangential line passing in contact with the side edge 16*b* of the inlet guide wall 16 extends at an acute angle $\theta$ relative to a tangential line passing in contact with the side edge 18*b* of the exit guide wall 18.

Thus, in the embodiment shown in FIGS. 14 and 15, the separating region is in the form of a ridge 20*a* defined by the obtuse angle $180°\theta$ described above and extending between the side panels 12*c* and 12*d* in parallel relation to the axis of rotation of the deflecting blade 24.

Except that the separation of the air current flowing out of the lower clearance below the deflecting blade 24 is enhanced in the fluid deflecting assembly of the construction shown in FIGS. 14 and 15, the latter functions in a substantially similar manner to the fluid deflecting assembly according to the embodiment shown in FIGS. 12 and 13.

It is to be noted that reference numeral 29 in FIGS. 12 and 13 designates a deflecting louver structure composed of a plurality of parallel blades for guiding the air stream, emerging from the exit opening 14*b*, in a direction laterally of the direction of flow of the air stream, for example, leftwards and rightwards.

In any event, the fluid deflecting assembly of the construction according to any one of the embodiments of FIGS. 12 and 13 and FIGS. 14 and 15 is particularly suited for application to an air conditioner as an exit grill structure through which heated or cooled air can emerge outwards from the exit opening 14*b* and into a space, for example, a house room, to be air-conditioned.

Figure 17:
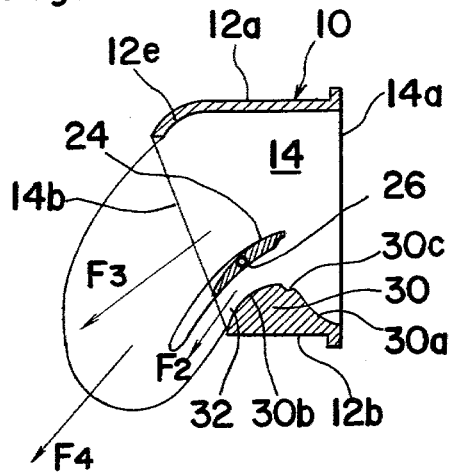
FIGS. 17 and 18 are side sectional views of the fluid deflecting assembly shown in FIG. 16, with the deflecting blade positioned at different operative positions.
Figure 18:
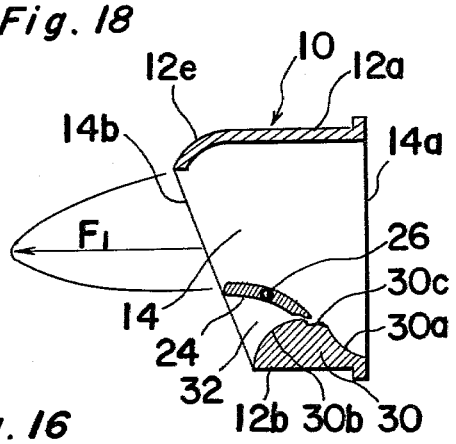
Figure 16:
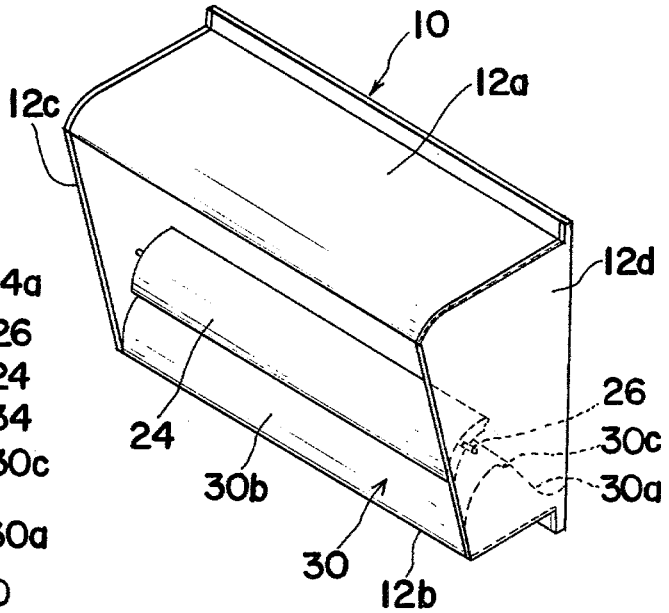
FIG. 16 is a schematic perspective view of the fluid deflecting assembly according to a sixth preferred embodiment of the present invention.

Referring now to FIGS. 16 to 18, instead of the employment of the substantially L-shaped beam 22 which has been described as employed in each of the foregoing embodiments, the side edge portion of the top panel 12*a* is curved downwards, as indicated at 12*e*, in a direction substantially towards the bottom panel 12*b*. In addition, the guide wall structure is rigidly mounted on the bottom panel 12*b* and is situated within the fluid duct 14 and is constituted by a substantially elongated wall block, generally indicated at 30, having a substantially streamlined cross section. This wall block 30 has a flat bottom surface rigidly mounted on, or otherwise integrally formed with, the bottom panel 12*b* and has a concave inlet wall area 30*a* and a convex exit wall area 30*b* defined on the opposite side of the flat bottom surface of said wall block 30. This wall block 30 is situated on the bottom panel 12*b* with the wall areas 30*a* and 30*b* respectively adjacent the supply opening 14*a* and the exit opening 14*b*. The junction between the wall areas 30*a* and 30*b* is indented as indicated at 30*c* and this indent 30*c* extends widthwise of the fluid duct 14, that is, between the side panels 12*c* and 12*d*, in parallel to the shaft 26.

The deflecting blade 24 employed in the embodiment of FIGS. 16 to 18 has a cross sectional shape similar to that of an airplane wing, i.e., a streamlined cross sectional shape, the upstream edge of said blade 24 being so shaped as to engage in the indent 30*c*, as best shown in FIG. 18, when the deflecting blade 24 is held in the lift position so that the flow passage defined at 32 between the wall block 30 and the deflecting blade 24 can be substantially closed for a purpose which will be described later. It is to be noted that the flow passage 32 between the wall block 30 and the deflecting blade 24 is a deflection aiding passage through which, as will be described later, the air current necessary to aid the deflection of the air stream emerging from the exit opening 14*b* flows. It is also to be noted that the rate of flow of the deflection aiding air current flowing through the passage 32 increases with an increase of the angle of the deflecting blade 24 between the lift and descent positions respectively shown in FIGS. 18 and 17.

The operation of the fluid deflecting assembly having the construction shown in FIGS. 16 to 18 will now be described with particular reference to FIGS. 17 and 18.

In FIG. 17, the deflecting blade 24 is shown in the descent position. In this condition, the air supplied into the fluid duct 14 from the source of air is first divided into two air currents; one air current flowing over the blade 24 and the other air current flowing under the blade 24 and through the passage 32. The air current flowing through the flow passage 32 is the deflection aiding air current referred to above and flows in a direction, shown by the arrow $F_2$, adhering to the exit wall area 30*b* by the action of the known Coanda effect. On the other hand, the air current flowing over the deflecting blade 24 is drawn towards the substantially convex surface of the deflecting blade 24 by the action of the known Coanda effect, thereby adhering to the convex surface of the deflecting blade 24. Simultaneously therewith, the air current flowing over the deflecting blade 24 is deflected downwardly deflected by the curved side edge portion 12*e* of the top panel 12*a* and, as a result thereof, is forced to flow in the direction as indicated by the arrow $F_3$.

As the air currents passing over and below the deflecting blade 24 emerge from the exit opening 14*b*, they join each other and the resultant air stream flows in the downward direction as indicated by the arrow $F_4$.

However, when the deflecting blade 24 is pivoted to the lift position as shown in FIG. 18, the deflection aiding flow passage 32 is closed by the deflecting blade 24 with the upstream edge of said blade 24 engaged in the indent 30*c*. Therefore, substantially the entire amount of air supplied into the fluid duct 14 will pass through the upper clearance between the deflecting blade 24 and the top panel 12*a*, flowing in the direction as indicated by $F_1$, that is, in the horizontal direction.

Figure 19:
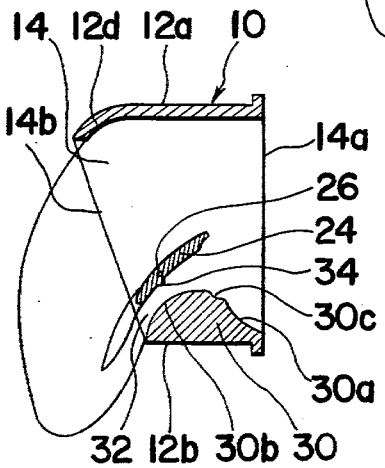
FIG. 19 is a view similar to either FIG. 17 or FIG. 18, showing the fluid deflecting assembly according to a seventh preferred embodiment of the present invention.

As shown in FIG. 19, the deflecting blade 24 employed in the fluid deflecting assembly of the construction shown in FIGS. 16 to 18 may have an elongated projection 34 extending lengthwise of said deflecting blade 24 and protruding towards the guide wall block 30. This projection 34 serves to throttle the deflection aiding flow passage 32 as the deflecting blade 24 is pivoted about the shaft 26 so that, depending upon the position of the deflecting blade 24, the deflection aiding air current flowing through the flow passage 32 will become a jet of air stream to facilitate the flow of the air current along the exit guide wall area 32.

Figure 20:
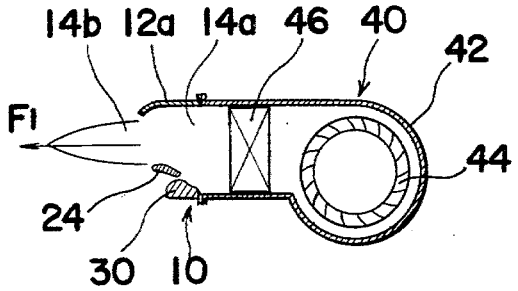
FIGS. 20 and 21 are schematic side sectional views of an air conditioner equipped with the fluid deflecting assembly shown in FIGS. 16 to 18 for the purpose of illustration of one particular application of the fluid deflecting assembly.
Figure 21:
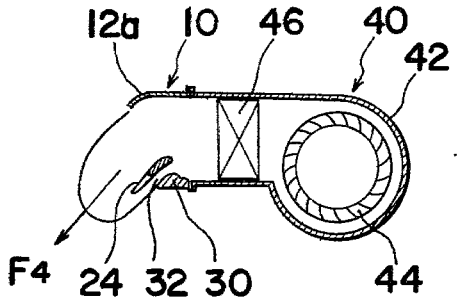

Referring now to FIGS. 20 and 21, there is illustrated one particular application of the fluid deflecting assembly of the construction shown in FIGS. 16 to 18. In these figures, the fluid deflecting assembly is shown as having applied to an air-conditioner of a type comprising an outdoor unit (not shown), including a compressor, and an indoor unit 40 adapted to be secured to a portion of a house wall adjacent the ceiling. In particular, the fluid deflecting assembly applied to the air-conditioner serves as the exit grill structure of the indoor unit of such air-conditioner from which a hot or cooled air stream emerges into a house room to be air-conditioned.

As illustrated, the indoor unit of the air-conditioner comprises a housing 42 having an elongated cylindrical fan assembly 44 which forms the source of air to be supplied to the supply opening 14*a* of the fluid deflecting assembly. The air from the fan assembly 44 flows through a heat exchanger 46 installed within the housing 42 at a position upstream of the supply opening 14*a* of the fluid deflecting assembly for exchanging heat energy to convert the air from the fan assembly 44 into cooled or warmed air. Whether the air from the fan assembly 44 is cooled or warmed depends upon the operational mode of the air-conditioner as is well known to those skilled in the art.

As can readily be seen from the description of the operation of the fluid deflecting assembly of FIGS. 16 to 18, when the deflecting blade 24 is set in the lift position as shown in FIG. 20, the air stream emerging from the exit opening 14*b* will flow in the horizontal direction substantially parallel to the ceiling within the house room to be air-conditioned. On the contrary, when the deflecting blade 24 is set in the descent position as shown in FIG. 21, the air stream emerging from the exit opening 14*b* will flow in the downward direction substantially perpendicular to the ceiling within the house room to be air-conditioned.

From the foregoing full description of the present invention, it is clear that not only can the pattern of flow of the air stream be fluid-dynamically controlled by only the deflecting blade, but also the employment of the single deflecting blade mimimizes the flow resistance.

Moreover, deflection of the air stream at a relatively wide angle can continuously be effected by pivoting the deflecting blade between the lift and descent positions even though the nozzle defining structure has a fluid duct of relatively small depth as measured in a direction parallel to the direction of flow of air from the supply opening to the exit opening.

Although the present invention has fully been described in connection with the preferred embodiments with reference to the accompanying drawings, it is to be noted that various changes and modifications will be apparent to those skilled in the art. By way of example, the fluid medium with which the fluid deflecting assembly according to the present invention can operate need not always be limited to air, but also may include any other gases or liquid.

Accordingly, these changes and modifications are to be understood as having included within the true scope of the present invention unless they depart therefrom.

What is claimed is:

1. A fluid deflecting assembly which comprises:

a fluid duct having supply and exit openings defined at respective ends of said fluid duct and through which a fluid medium flows from the supply opening towards the exit opening;

means defined at a position adjacent the exit opening for directing a portion of the fluid medium flowing through the fluid duct to flow inwardly of said fluid duct;

a guide wall structure having an outwardly diverging wall area adjacent the exit opening, said outwardly diverging wall area diverging outwards in a direction downstream with respect to the direction of the flow of the fluid medium, said guide wall structure further having a separating region and having an inlet guide wall area positioned adjacent the supply opening in opposed relation to the outwardly diverging wall area, said separating region being at the junction between the inlet wall area and the outwardly diverging wall area; and a pivotally supported deflecting blade for deflecting the flow of the fluid medium flowing through the fluid duct, said deflecting blade being positioned within the fluid duct for controlling the stream of fluid medium to cause the latter to adhere to the outwardly diverging wall area of the guide wall structure depending upon the position of the deflecting blade.

* * * * *